US006244252B1

(12) United States Patent
Burborough

(10) Patent No.: US 6,244,252 B1
(45) Date of Patent: Jun. 12, 2001

(54) ADVANCE ARRANGEMENT

(75) Inventor: William Robert Burborough, Gillingham (GB)

(73) Assignee: Lucas Industries Limited (GB)

( * ) Notice: Subject to any disclaimer, the term of this patent is extended or adjusted under 35 U.S.C. 154(b) by 0 days.

(21) Appl. No.: 09/448,342

(22) Filed: Nov. 23, 1999

(30) Foreign Application Priority Data

Feb. 12, 1998 (GB) ..... 9826348

(51) Int. Cl.[7] ..... F02M 37/04
(52) U.S. Cl. ..... 123/502
(58) Field of Search ..... 123/502

(56) References Cited

U.S. PATENT DOCUMENTS

| | | | | |
|---|---|---|---|---|
| 4,138,981 | | 2/1979 | Green . | |
| 4,397,285 | | 8/1983 | O'Neill . | |
| 4,534,332 | | 8/1985 | Eheim et al. . | |
| 4,619,238 | | 10/1986 | Hain et al. . | |
| 4,796,592 | * | 1/1989 | Hofer et al. | 123/502 |
| 5,180,290 | * | 1/1993 | Green | 123/502 |
| 5,188,083 | * | 2/1993 | Reisser et al. | 123/502 |
| 5,263,457 | | 11/1993 | Konrath et al. . | |
| 5,413,079 | * | 5/1995 | Laufer | 123/502 |
| 5,413,080 | * | 5/1995 | Laufer | 123/502 |
| 5,638,794 | * | 6/1997 | Kubo et al. | 123/502 |
| 5,655,502 | * | 8/1997 | Enomoto et al. | 123/502 |

* cited by examiner

*Primary Examiner*—Thomas N. Moulis
(74) *Attorney, Agent, or Firm*—Trexler, Bushnell, Giangiorgi, Blackstone & Marr, Ltd.

(57) ABSTRACT

An advance arrangement comprising an advance piston slidable within a bore under the action of fuel pressure within a control chamber, a surface associated with the piston being exposed to the fuel pressure within the control chamber. The control chamber communicates, through a restricted flow passage, with a low pressure fuel volume. A valve is operable to vary the restriction to flow formed by the restricted flow passage.

9 Claims, 1 Drawing Sheet

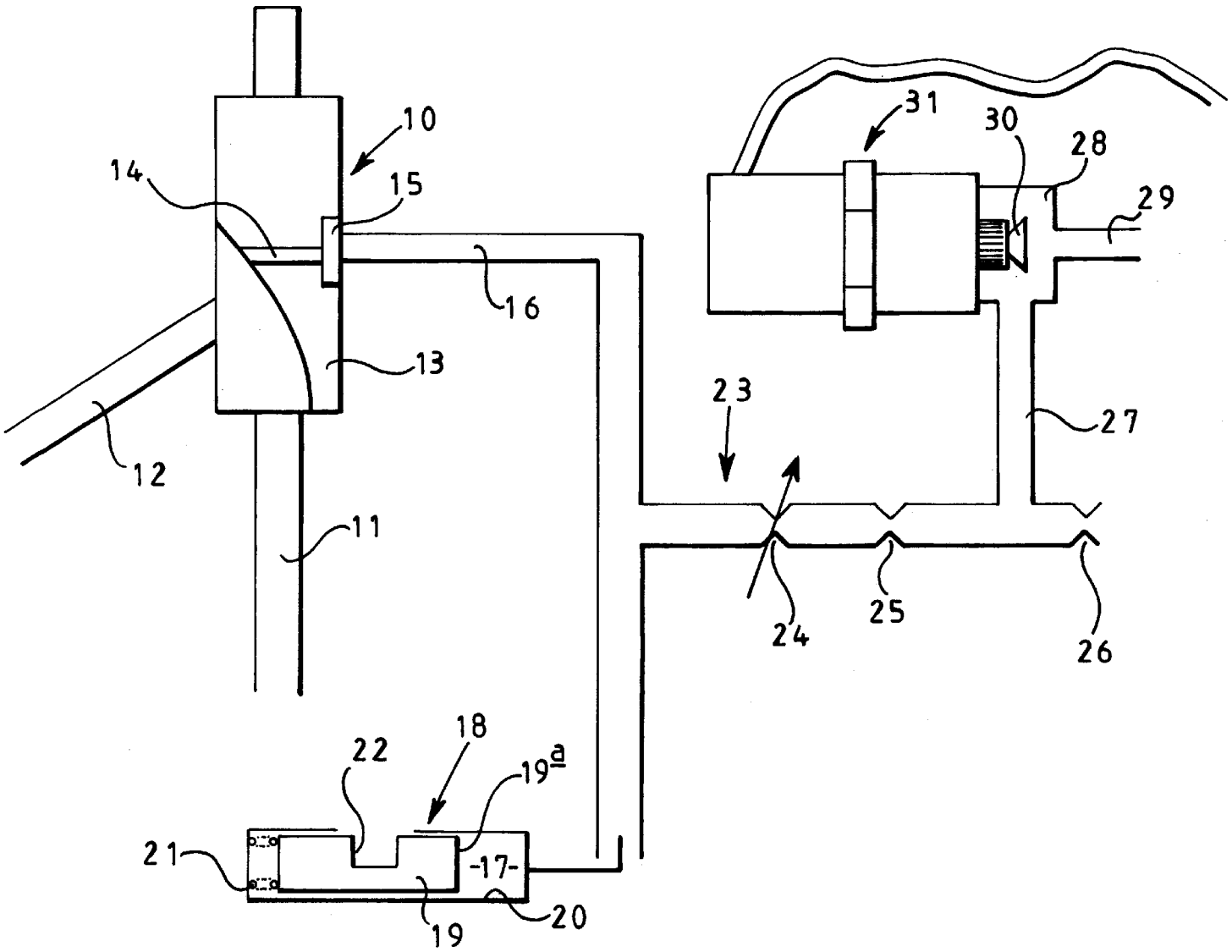
10
11
12
13
14
15
16
17
18
19
19a
20
21
22
23
24
25
26
27
28
29
30
31

ADVANCE ARRANGEMENT

This invention relates to an advance arrangement for use in controlling the timing of fuel delivery by a high pressure fuel pump.

A rotary distributor high pressure fuel pump conveniently includes an advance arrangement for use in controlling the timing of fuel delivery by the pump, and hence for controlling the timing of commencement of fuel injection through injectors associated with the pump. The advance arrangement typically comprises an angularly adjustable cam ring having a cam surface with which one or more plungers cooperate, in use. The position of the cam ring is adjustable by means of an advance piston which cooperates with a peg secured to the cam ring such that axial movement of the piston causes angular movement of the cam ring. The advance piston may be spring biased towards a first position, fuel under pressure being applied to the piston to move the piston against the spring biasing towards a second position. In a more complex arrangement, the advance piston may be of the servo-advance type. The fuel pressure applied to the advance piston is typically associated with engine speed, thus the timing of fuel injection is associated with engine speed.

It is an object of the invention to provide an advance arrangement in which corrections for other factors, for example air temperature or density, altitude or fuel cetane number, can be made to the timing of fuel delivery.

According to the present invention there is provided an advance arrangement comprising an advance piston slidable within a bore under the action of the fuel pressure within a control chamber, a surface associated with the piston being exposed to the fuel pressure within the control chamber, the control chamber communicating, through a restricted flow passage, with a low pressure fuel volume, and a valve operable to vary the restriction to flow formed by the restricted flow passage.

Conveniently, the valve may be a solenoid actuable valve.

The advance piston may simply comprise a piston slidable within a bore, or may comprise a servo-advance piston having a servo piston slidable within the advance piston controlling the position of the advance piston.

The invention will further be described, by way of example, with reference to the accompanying diagrammatic view of an advance arrangement in accordance with an embodiment of the invention.

The advance arrangement illustrated, diagrammatically, in the accompanying drawing comprises a metering valve arrangement 10 arranged to control the rate at which fuel is supplied from an inlet passage 11 which communicates with the outlet of a low pressure transfer pump (not shown) to an outlet passage 12 which communicates with the inlet of a high pressure fuel pump (not shown). The metering valve arrangement 10 comprises a valve member 13 provided with a recess, the valve member 13 being angularly adjustable within a bore to control the degree by which the end of the outlet passage 12 which communicates with the bore is obscured by the valve member 13, thereby controlling the rate of fuel flow to the high pressure pump. The recess of the valve member 13 further communicates through a relatively small diameter drilling 14 and a recess 15 with a passage 16. The drilling 14, recess 15 and passage 16 are located so that the rate at which fuel flows to the passage 16 is varied when the valve member 13 is moved.

The passage 16 communicates with a control chamber 17 of an advance piston arrangement 18. The advance piston arrangement 18 comprises an advance piston 19 slidable within a bore 20, the control chamber 17 being defined by an end surface 19*a* of the advance piston 19 and part of the bore 20. A spring 21 is provided within the bore 20, the spring 21 urging the piston 19 towards a position in which the volume of the control chamber 17 is relatively small. It will be appreciated that the position adopted by the piston 19, in use, is dependent upon the fuel pressure applied to the control chamber 17.

The advance piston 19 is provided with a recess 22 which receives, in use, a peg or tooth attached to or forming part of a cam ring of the high pressure fuel pump, the cam ring being angularly adjustable to vary the timing of fuel delivery, the position of the cam ring being dependent upon the axial position of the piston 19 within the bore 20.

The passage 16 further communicates with a restricted flow passage 23 which includes a first, variable flow restriction 24, a second flow restriction 25 and a third flow restriction 26. The restricted flow passage 23 opens into a low pressure fuel volume, for example the cam box of the high pressure fuel pump.

Intermediate the second and third flow restrictions 25, 26, the restricted flow passage 23 communicates with a bypass passage 27. The bypass passage 27 opens into a chamber 28 which communicates with a further passage 29. A valve member 30 of a solenoid actuable valve 31 is located within the chamber 28 and is moveable under the influence of the solenoid actuator of the valve 31 between a rest position (as illustrated) and an actuated position in which the end of the further passage 29 which opens into the chamber 28 is closed by the valve member 30. It will be appreciated that, in this position, communication between the bypass passage 27 and the further passage 29 is broken. The further passage 29 also communicates with the low pressure fuel volume, for example the cam box of the high pressure fuel pump.

In use, fuel is supplied by the transfer pump to the metering valve 10 and from the metering valve to the high pressure fuel pump at a rate governed by the angular position of the valve member 13. Fuel is also supplied through the drilling 14 and recess 15 to the passage 16 at a rate governed by the angular position of the metering valve member 13. The fuel supplied to the passage 16 acts to pressurize the control chamber 17, applying a force to the end surface 19*a* of the piston 19 acting against the spring 21 and urging the piston 19 towards a position governed by the fuel pressure within the control chamber 17. The position adopted by the advance piston 19 determines the angular position of the cam ring of the high pressure fuel pump, and thus determines the timing of fuel delivery by the pump.

The fuel pressure within the control chamber 17 is not only dependent upon the rate at which fuel is supplied to the passage 16 through the valve member 13, but is also dependent upon the rate at which fuel can flow from the passage 16 through the restricted flow passage 23. With the solenoid actuable valve 31 in the position illustrated, the rate at which fuel is able to escape from the passage 16 through the restricted flow passage 23 is governed by the first and second restrictions 24, 25, the relatively unrestricted fuel flow path through the bypass passage 27, chamber 28 and further passage 29 resulting in the third restriction 26 having little effect upon the rate of fuel flow from the passage 16. The setting of the first restriction 24 is chosen to achieve the desired timing of fuel delivery when the valve 31 occupies its rest position, the second restriction 25 being provided to desensitise the arrangement so that small changes in the setting of the first restriction 24 have little impact upon the operation of the arrangement.

If, in use, the position of the metering valve changes to alter the fuel supply to the high pressure pump and the engine, then the fuel flow rate to the passage 16 will also vary. The fuel pressure applied to the control chamber 17 will thus change leading to a shift in the position of the piston 19 and to a change in the timing of fuel delivery by the pump.

If it is determined that the timing of fuel injection should be advanced, for example as a result of the engine operating under low ambient temperature conditions, then the actuator of the solenoid actuable valve 31 may be energized to move the valve member 30 to its alternative position in which communication between the bypass passage 27 and further passage 29 is broken. It will be appreciated that in these circumstances, fuel flowing through the restricted flow passage 23 must flow through the third restriction 26 in order to escape to the low pressure fuel volume. As a result, the rate at which fuel can escape from the passage 16 is reduced, and the fuel pressure within the control chamber 17 will rise. The increase in fuel pressure within the control chamber 17 will urge the advance piston 19 to adopt a position in which the timing of fuel delivery by the high pressure fuel pump is advanced compared to the position which would otherwise be adopted by the piston. The effect of actuating the valve 31 does not effect the maximum level of advance of the timing of fuel delivery of the timing of fuel delivery under full load conditions.

In the embodiment illustrated, the fuel pressure applied to the control chamber 17 through the metering valve 13 is arranged to vary in such a manner that fuel can flow towards the control chamber 17 at an increased rate when the engine is operating at low speed. It will be appreciated, however, that, if desired, the rate at which fuel is supplied towards the control chamber 17 may be arranged to increase with increasing engine speed.

The solenoid actuator arrangement 31 may be actuable in response to the ambient air temperature as described hereinbefore, or alternatively may be responsive to changes in air density, altitude or cetane number of the fuel.

Although in the description hereinbefore, the advance arrangement is described with reference to a fuel pump of the rotary distributor type including an angularly adjustable cam ring, it will be appreciated that the invention is also applicable to other types of fuel pump in which the timing of fuel injection can be altered. Further, although in the description hereinbefore, a simple advance piston is described, it will be appreciated that the invention is also suitable for use with servo-advance type arrangements.

What is claimed is:

1. An advance arrangement comprising an advance piston slidable within a bore under the action of fuel pressure within a control chamber, a surface associated with said piston being exposed to said fuel pressure within said control chamber, said control chamber communicating, through a restricted flow passage, with a low pressure fuel volume, a valve being operable to vary the restriction to flow formed by said restricted flow passage, wherein said advance arrangement further comprises a metering valve arrangement arranged to control the rate at which fuel is supplied to an outlet in communication with a high pressure fuel pump and the rate at which fuel is supplied to said control chamber.

2. The advance arrangement as claimed in claim 1, wherein said valve is a solenoid actuable valve.

3. The advance arrangement as claimed in claim 1, wherein said valve includes a valve member located within a chamber and movable under the influence of an actuator.

4. The advance arrangement as claimed in claim 1, wherein said advance piston comprises a piston slidable within a bore.

5. The advance arrangement as claimed in claim 1, wherein said restricted flow passage comprises one or more restrictions to flow.

6. The advance arrangement as claimed in claim 5, wherein said restricted flow passage comprises a variable restriction to flow.

7. The advance arrangement as claimed in claim 5, wherein said restricted flow passage communicates with a by-pass passage which provides a relatively unrestricted fuel flow path between said restricted passage and said low pressure volume when said valve occupies an open position.

8. The advance arrangement as claimed in claim 1, wherein said valve is operable in response to any one of the ambient air temperature, changes in air density, changes in altitude or changes in the cetane number of fuel.

9. The advance arrangement as claimed in claim 1, wherein said metering valve arrangement comprises a valve member which is angularly adjustable within a bore to control said rate of fuel supply to said outlet and to said control chamber.

* * * * *